US010529472B2

(12) United States Patent
Kirk et al.

(10) Patent No.: US 10,529,472 B2
(45) Date of Patent: Jan. 7, 2020

(54) LOW ASPECT RATIO VARISTOR

(71) Applicant: AVX Corporation, Fountain Inn, SC (US)

(72) Inventors: Michael Kirk, Simpsonville, SC (US); Marianne Berolini, Greenville, SC (US); Palaniappan Ravindranathan, Simpsonville, SC (US)

(73) Assignee: AVX Corporation, Fountain Inn, SC (US)

( * ) Notice: Subject to any disclaimer, the term of this patent is extended or adjusted under 35 U.S.C. 154(b) by 0 days.

(21) Appl. No.: 16/205,271

(22) Filed: Nov. 30, 2018

(65) Prior Publication Data

US 2019/0172613 A1 Jun. 6, 2019

Related U.S. Application Data

(60) Provisional application No. 62/593,340, filed on Dec. 1, 2017.

(51) Int. Cl.
*H01C 7/12* (2006.01)
*H01C 1/16* (2006.01)
(Continued)

(52) U.S. Cl.
CPC ..... *H01C 7/12* (2013.01); *H01C 1/142* (2013.01); *H01C 1/16* (2013.01); *H01C 7/1006* (2013.01)

(58) Field of Classification Search
CPC ..... H01C 7/12; H01C 7/1006; H01C 1/142; H01C 1/16
See application file for complete search history.

(56) References Cited

U.S. PATENT DOCUMENTS 4,581,159 A 4/1986 Hennings et al.
4,660,017 A * 4/1987 Momoki ..... H01C 7/102 338/21
(Continued)

FOREIGN PATENT DOCUMENTS

EP 0 388 022 A2 9/1990
KR 100848192 B1 7/2008

OTHER PUBLICATIONS

International Search Report and Written Opinion for PCT/US2018/063224 dated Apr. 2, 2019, 12 pages.
(Continued)

*Primary Examiner* — Kyung S Lee
(74) *Attorney, Agent, or Firm* — Dority & Manning, P.A.

(57) ABSTRACT

A low aspect ratio varistor is disclosed. The varistor may have a rectangular configuration defining first and second opposing side surfaces offset in a widthwise direction and first and second opposing end surfaces offset in a lengthwise direction. The varistor may include a first electrode layer including a first electrode having an electrode length in the lengthwise direction and an electrode width in the widthwise direction. The varistor may also include a second electrode layer including a second electrode having an electrode length in the lengthwise direction and an electrode width in the widthwise direction. The varistor may also include first and second terminals adjacent and connected with the first and second opposing end surfaces, respectively. At least one of the first or second electrodes may have an electrode aspect ratio less than about 1.

20 Claims, 8 Drawing Sheets

(51) Int. Cl.
*H01C 1/142* (2006.01)
*H01C 7/10* (2006.01)

(56) References Cited

U.S. PATENT DOCUMENTS

| | | | | |
|---|---|---|---|---|
| 4,819,128 | A * | 4/1989 | Florian | H01G 4/232 338/21 |
| 7,075,405 | B2 | 7/2006 | Takehana et al. | |
| 7,808,770 | B2 | 10/2010 | Itamura et al. | |
| 8,699,204 | B2 | 4/2014 | Demcko et al. | |
| 8,988,857 | B2 | 3/2015 | McConnell et al. | |
| 9,326,381 | B2 | 4/2016 | Lee et al. | |
| 2001/0002873 | A1* | 6/2001 | Tanaka | H01C 1/14 361/306.3 |
| 2003/0011962 | A1* | 1/2003 | Yamamoto | H01G 4/232 361/321.2 |
| 2004/0027787 | A1* | 2/2004 | Yamauchi | H01G 4/012 361/321.2 |
| 2005/0180091 | A1 | 8/2005 | Hayworth et al. | |
| 2008/0165468 | A1 | 7/2008 | Berolini et al. | |
| 2009/0147440 | A1 | 6/2009 | Cygan et al. | |
| 2011/0317328 | A1* | 12/2011 | Taniguchi | H01G 4/005 361/321.1 |
| 2013/0229748 | A1 | 9/2013 | Chung et al. | |

OTHER PUBLICATIONS

Product Information on VC Series Low Voltage 125°C from © KEMET Electronics Corporation dated Feb. 9, 2017, 16 pages.

* cited by examiner

LOW ASPECT RATIO VARISTOR

CROSS REFERENCE TO RELATED APPLICATION

The present application claims filing benefit of U.S. Provisional Patent Application Ser. No. 62/593,340 having a filing date of Dec. 1, 2017, which is incorporated herein by reference in its entirety.

BACKGROUND OF THE INVENTION

The present subject matter generally relates to electronic components adapted to be mounted on a circuit board and more particularly to a varistor and varistor array.

Multilayer ceramic devices, such as multilayer ceramic capacitors or varistors, are typically constructed with a plurality of stacked dielectric-electrode layers. During manufacture, the layers may often be pressed and formed into a vertically stacked structure. Multilayer ceramic devices can include a single electrode or multiple electrodes in an array.

Varistors are voltage-dependent nonlinear resistors and have been used as surge absorbing electrodes, arresters, and voltage stabilizers. Varistors may be connected, for example, in parallel with sensitive electrical components. The non-linear resistance response of varistors is often characterized by a parameter known as the clamping voltage. For applied voltages less than the clamping voltage of a varistor, the varistor generally has very high resistance and, thus, acts similar to an open circuit. When the varistor is exposed to voltages greater than the clamping voltage of the varistor, however, the resistance of the varistor is reduced, such that the varistor acts more similar to a short circuit, allowing a greater flow of current through the varistor. This non-linear response may be used divert current surges away from sensitive electronic components to protect the sensitive electronic components.

For some time, the design of various electronic components has been driven by a general industry trend toward miniaturization. Miniaturization of electronic components has resulted in lower operating currents and reduced durability for current surges. Thus, a compact varistor array having a low clamping voltage would be desirable.

SUMMARY OF THE INVENTION

In accordance with one embodiment of the present invention, a varistor is disclosed having a rectangular configuration defining first and second opposing side surfaces offset in a widthwise direction and first and second opposing end surfaces offset in a lengthwise direction. The varistor comprises a first terminal adjacent the first opposing end surface and a first electrode layer including a first electrode having an electrode length in the lengthwise direction and an electrode width in the widthwise direction. The first electrode is connected with the first terminal along the electrode width of the first electrode. The varistor also comprises a second terminal adjacent the second opposing end surface and a second electrode layer including a second electrode having an electrode length in the lengthwise direction and an electrode width in the widthwise direction. The second electrode is connected with the second terminal along the electrode width of the second electrode. At least one of the first or second electrodes may have an electrode aspect ratio less than about 1.

In accordance with another embodiment of the present invention, a varistor is provided having a rectangular configuration defining first and second opposing side surfaces offset in a widthwise direction and first and second opposing end surfaces offset in a lengthwise direction. The varistor comprises a first terminal adjacent the first opposing end surface and a first electrode layer including a first electrode. The first electrode is connected with the first terminal. The varistor includes a second terminal adjacent the second opposing end surface and a second electrode layer including a second electrode. The second electrode is connected with the second terminal. The second electrode overlaps the first electrode along an overlapping area. The overlapping area has an overlap aspect ratio less than about 1.

In accordance with another embodiment of the present invention a varistor array is provided having a rectangular configuration defining first and second opposing side surfaces offset in a widthwise direction and first and second opposing end surfaces offset in a lengthwise direction. The varistor array comprises a first terminal associated with the first opposing end surface and a first electrode layer including a first set of electrodes. Each of the first set of electrodes is connected with the first terminal, and each has an electrode length in the lengthwise direction and an electrode width in the widthwise direction. The varistor array comprises a second terminal associated with the second opposing end surface and a second electrode layer including a second set of electrodes. Each of the second set of electrodes is connected with the second terminal and has an electrode length in the lengthwise direction and an electrode width in the widthwise direction. At least one of electrodes of the second set of electrodes or the first set of electrodes has an electrode aspect ratio less than about 1.

BRIEF DESCRIPTION OF THE DRAWINGS

A full and enabling disclosure of the present subject matter, including the best mode thereof, directed to one of ordinary skill in the art, is set forth in the specification, which makes reference to the appended FIGS., in which.

Figure 1A:
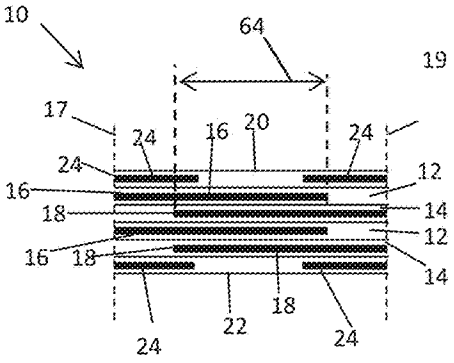
FIG. 1A is a section view of one embodiment of a varistor in accordance with aspects of this disclosure

Repeat use of reference characters throughout the present specification and appended drawings is intended to represent same or analogous features, electrodes, or steps of the present subject matter.

DETAILED DESCRIPTION OF THE PREFERRED EMBODIMENTS

It is to be understood by one skilled in the art that the present disclosure is a description of exemplary embodiments only, and is not intended as limiting the broader aspects of the present subject matter, which broader aspects are embodied in the exemplary constructions.

Generally, the present disclosure is directed to a varistor and a varistor array having a reduced clamping voltage. Generally, reducing the active resistance of a varistor may provide a reduced clamping voltage. Many factors many contribute to the active resistance of the varistor, including, for example, the properties of materials used to form the varistor and dimensions of the varistor and electrodes of the varistor.

The varistor may include a plurality of alternating dielectric layers, and each layer may include an electrode. The dielectric layers may be pressed together and sintered to form a unitary structure. The dielectric layers may include any suitable dielectric material, such as, for instance, barium titanate, zinc oxide, or any other suitable dielectric material. Various additives may be included in the dielectric material, for example, that produce or enhance the voltage-dependent resistance of the dielectric material. For example, in some embodiments, the additives may include oxides of cobalt, bismuth, manganese, or a combination thereof. In some embodiments, the additives may include oxides of gallium, aluminum, antimony, chromium, titanium, lead, barium, nickel, vanadium, tin, or combinations thereof. The dielectric material may be doped with the additive(s) ranging from about 0.5 mole percent to about 3 mole percent, and in some embodiments from about 1 mole percent to about 2 mole percent. The average grain size of the dielectric material may contribute to the non-linear properties of the dielectric material. In some embodiments, the average grain size may range from about 10 microns to 100 microns, in some embodiments, from about 20 microns to 80 microns. The varistor may also include two terminals, and each electrode may be connected with a respective terminals. Electrodes may provide resistance along the length of the electrodes and/or at the connection between the electrodes and terminals.

Regardless of the particular configuration employed, the present inventors have discovered that through selective control over the aspect ratio of the electrodes and/or overall dimensions, a varistor can be achieved that exhibits a reduced clamping voltage. For instance, in some embodiments, at least one electrode may have an aspect ratio defined as the length of the electrode divided by the width of the electrode. In some embodiments, the electrode aspect ratio of at least one electrode may be less than 1. For example, in some embodiments, the electrode aspect ratio may be greater than about 0.05 and less than 1, in some embodiments greater than about 0.1 and less than about 0.9, in some embodiments greater than about 0.2 and less than about 0.8, in some embodiments greater than about 0.3 and less than about 0.7.

In some embodiments, the electrodes may overlap or interleave in the lengthwise and widthwise directions. The size and shape of the overlapping area between the electrodes may also affect the active resistance, and thus the clamping voltage of the varistor. The overlapping area may have an overlap aspect ratio defined as the length of the overlapping area divided by the width of the overlapping area. In some embodiments, the overlap aspect ratio may be less than 1. For example, in some embodiments, the overlap aspect ratio may be greater than about 0.05 and less than 1, in some embodiments greater than about 0.1 and less than about 0.9, in some embodiments greater than about 0.2 and less than about 0.8, in some embodiments greater than about 0.3 and less than about 0.7.

In accordance with aspects of the present disclosure, in some embodiments, a varistor or varistor array may have an overall aspect ratio defined as the length of the varistor or varistor array divided by the width of the varistor or varistor array. In some embodiments, the overall aspect ratio may be less than 1. For example, in some embodiments, the overall aspect ratio may be greater than about 0.05 and less than 1, in some embodiments greater than about 0.1 and less than about 0.9, in some embodiments greater than about 0.2 and less than about 0.8, in some embodiments greater than about 0.3 and less than about 0.7.

In some embodiments, a varistor or varistor array in accordance with aspects of this disclosure may have a clamping voltage less than about 40 volts. For example, in some embodiments, the varistor 10 may have a clamping voltage ranging from about 1 volt to about 24 volts, and in some embodiments, from about 2 volts and to about 12 volts, and in some embodiments from about 3 volts and to about 8 volts, and in some embodiments, from about 4 volts to about 6 volts.

Referring now to the figures, exemplary embodiments of the present disclosure will now be discussed in detail. FIGS. 1A-1D illustrate one embodiment of a varistor 10 in accordance with aspects of the present disclosure. FIG. 1A is a schematic section view showing the various layers of one embodiment of the varistor 10. In one embodiment, the varistor 10 may include a plurality of generally planar dielectric layers made of, for example, a ceramic dielectric material, as described above.

Referring to FIG. 1A, the varistor 10 may include alternating first layers 12 and second layers 14. Each first layer 12 may include a first electrode 16 connected with a first terminal 17, and each second layer 14 may include a second electrode 18 connected with a second terminal 19. The electrodes 16, 18 may be formed from a conductor such as palladium, silver, platinum, copper, or another suitable conductor capable of being printed on the dielectric layer.

The varistor 10 may also include a top dielectric layer 20 and a bottom dielectric layer 22. In some embodiments, one or more of the top and bottom dielectric layers 20, 22 may include dummy electrodes 24. While the varistor 10 is illustrated as having a single top dielectric layer 20 and a single bottom dielectric layer 22, it should be understood that any suitable number of top or bottom dielectric layers 20, 22 can be used without deviating from the scope of the present disclosure. Additionally, in some embodiments, the top and bottom dielectric layers 20, 22 may not include any dummy electrodes 24, or any electrodes whatsoever.

It should also be understood that the present disclosure is not limited to any particular number of dielectric-electrode layers. For instance, in some embodiments, the varistor 10 may include 2 or more dielectric-electrode layers, 4 or more dielectric-electrode layers, 8 or more dielectric electrode layers, 10 or more dielectric-electrode layers, 20 or more dielectric-electrode layers, 30 or more dielectric-electrode layers, or any suitable number of dielectric-electrode layers.

Figure 1B:
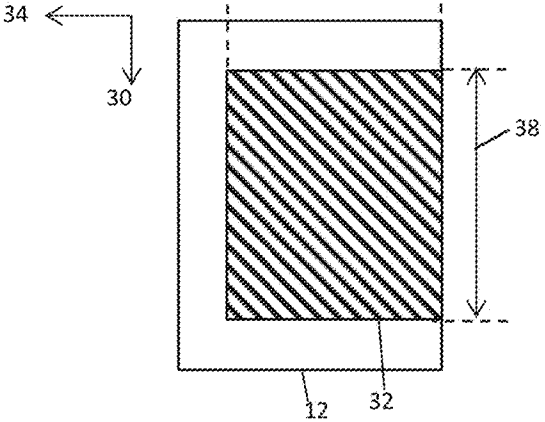
FIG. 1B is a top down view of a layer of the varistor of FIG. 1A.
Figure 1C:
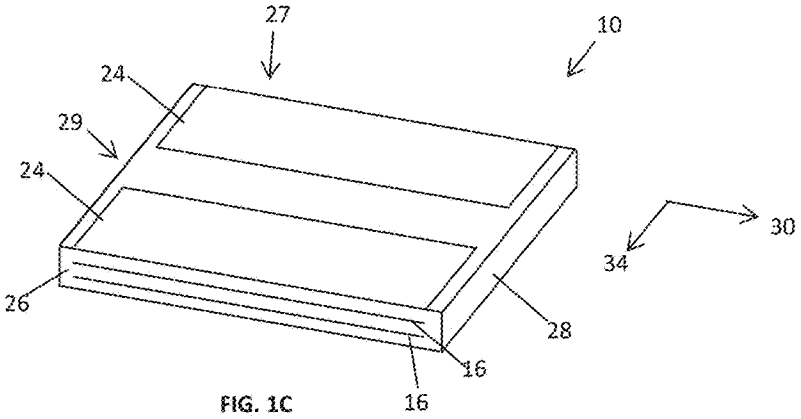
FIG. 1C is a perspective view of the varistor of FIG. 1A shown without terminals.
Figure 1D:
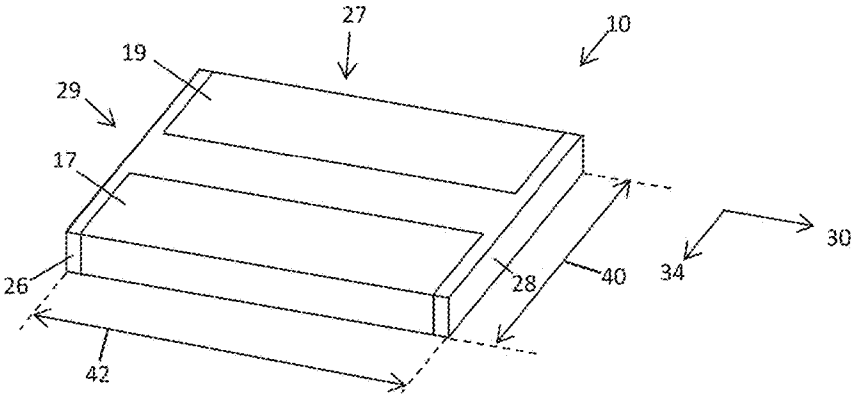
FIG. 1D is a perspective view of the varistor of FIG. 1A shown with terminals.

Referring to FIGS. 1C and 1D, the varistor 10 may have a first end surface 26. Although not shown from the viewpoint of FIGS. 1C and 1D it should be understood that the varistor 10 may include a second end surface 27 opposite the first end surface 26 and offset in a lengthwise direction 34. The varistor 10 may also have a first side surface 28, and although not shown from the viewpoint of FIGS. 1C and 1D, it should be understood that the varistor may include a second side surface 29 opposite the first side surface 28 and offset in the widthwise direction 30.

FIG. 1B illustrates the first layer 12 of the varistor 10. In some embodiments, the layers 12, 14 and electrodes 16, 18 may each have a generally rectangular shape. Each electrode 16, 18 may have a length 36 in the lengthwise direction 34 and a respective width 38 in the widthwise direction 30.

FIG. 1C illustrates the varistor 10 without any terminals. As indicated above, in some embodiments the top layer 22 of the varistor 10 may include dummy electrodes 24. The edges of the first electrodes 16 may extend to the first end surface 26. Referring to FIG. 1D, the varistor 10 may include termination structures for coupling the internal electrodes 16, 18 of varistor 10 to a printed circuit board. The termination structures may include the first terminal 17 and second terminal 19. The first and second terminals 17, 19 may include a metallization layer of platinum, copper, palladium silver, or other suitable conductor material. A chromium/nickel layer, followed by a silver/lead layer, applied by typical processing techniques such as sputtering, can be used as an outer conductive layer for the termination structures.

As illustrated in FIG. 1D, the first terminal 17 may be disposed on the first end surface 26 of the varistor 10 such that it is electrically connected with the first electrodes 16. The first electrodes 16 may extend to the first end surface 26 of the varistor 10 and connect with the first terminal 17. Additionally, the second terminal 19 may be disposed on the second end surface 27 of the varistor, and the second electrodes 18 may extend to the second end surface 27 of the varistor 10 and connect with the second terminal 19.

As indicated above, the top dielectric layer 20 and/or bottom dielectric layer 22 may include dummy electrodes 24. In some embodiments, the dummy electrodes 24 may improve the electrical connection with the terminals 17, 19. For example, terminal material may be deposited along the first and second end surfaces 26, 27 such that the dummy electrodes 24 form part of the terminals 17, 19, and each terminal 17, 19 wraps around a respective end of the varistor 10. In some embodiments, the terminals 17, 19 may be deposited, or otherwise formed, on top of the dummy electrodes 24 such that the terminals 17, 19 wrap around each end of the varistor 10. In other embodiments, however, the varistor 10 may not include any dummy electrodes 24, and the terminals 17, 19 may not be disposed along the top and bottom surfaces of the varistor 10. For example, in some embodiments, the terminals may be disposed only on the first and second end surfaces 26, 27.

Referring to FIG. 1D, the varistor 10 may have an overall length 40 in the lengthwise direction 34 and an overall width 42 in the widthwise direction 30. The overall length 40 and/or overall width 42 may include the terminals 17, 19.

Referring to FIGS. 2A-2D, in another embodiment, at least one of the electrodes 16, 18 may be configured as a T-electrode. This embodiment may otherwise be generally configured similarly to the embodiment illustrated in FIGS. 1A-1D. The T-electrodes may have a protruding portion 54 having two opposite side edges and an end edge. The T-electrodes may also have one or more shoulder portions 56. Referring to FIGS. 2A-2D, first terminal 17 may be connected with the first electrode 16 along at least one of the first side surface 28 or second side surface 29 of the varistor 10.

According with aspects of the present disclosure, the T-electrode configuration may provide an improved electrical connection between the electrodes 16, 18 and terminals 17, 19, which may result in a lower active resistance, and thus a lower clamping voltage. As shown in FIGS. 2B and 2C, in this embodiment, the electrode 16 may extend to at least one of the first side surface 28 or second side surface 29. For example, one of the shoulder portions 56 may intersect the first side surface 28, and the other of the shoulder portions 56 may intersect the second side surface 29. Each shoulder portion 56 may define a side length 58 along which the shoulder portion 56 extends one of the first and second side surfaces 28, 29. As shown in FIG. 2D, in some embodiments, the terminals 17, 19 may be formed along a portion of the first side surface 28 and/or second side surface 29 such that the terminals 17, 19 electrically connect with the respective electrodes 16, 18 along the side surfaces 28, 29. In some embodiments, side length ratio of the overall length 40 of the varistor 10 divided by the side length 58 of the varistor 10 may range from about 2.5 to about 10, in some embodiments from about 3 to about 10, in some embodiments from about 4 to about 10, and in some embodiments from about 5 to about 10.

Figure 2A:
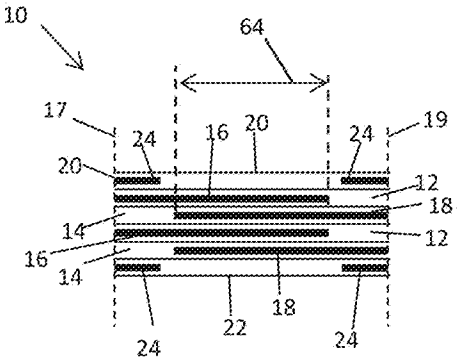
FIG. 2A is a section view of a T-electrode embodiment of a varistor in accordance with aspects of this disclosure.
Figure 2B:
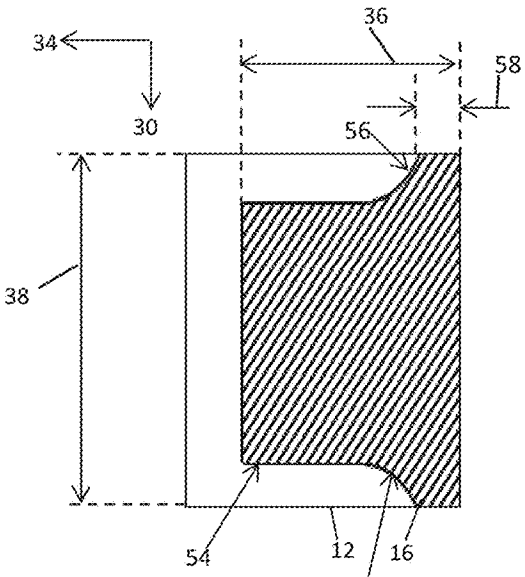
FIG. 2B is a top down view of a layer of the varistor of FIG. 2A.
Figure 2C:
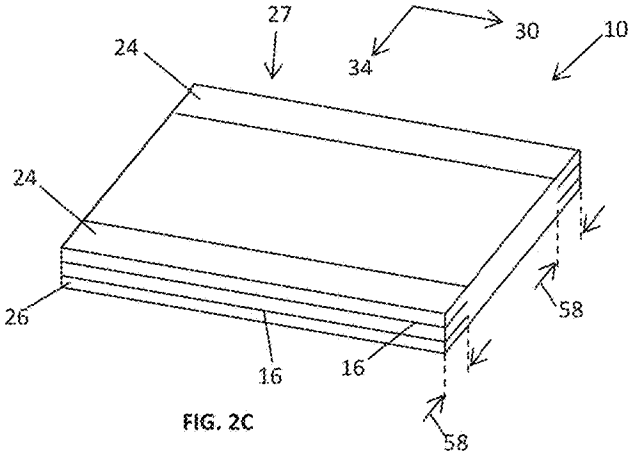
FIG. 2C is a perspective view of the varistor of FIG. 2A shown without terminals.
Figure 2D:
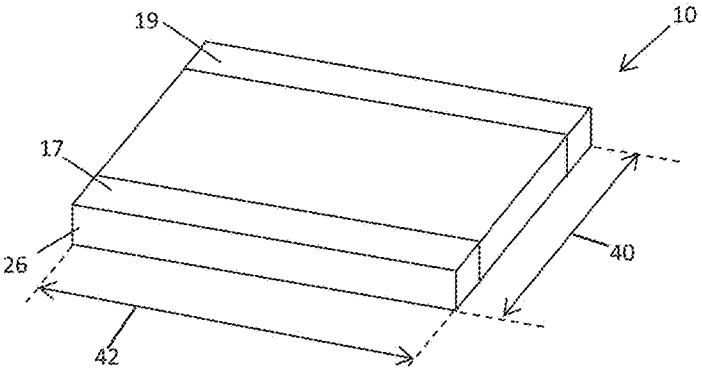
FIG. 2D is a perspective view of the varistor of FIG. 2A shown with terminals.
Figure 3B:
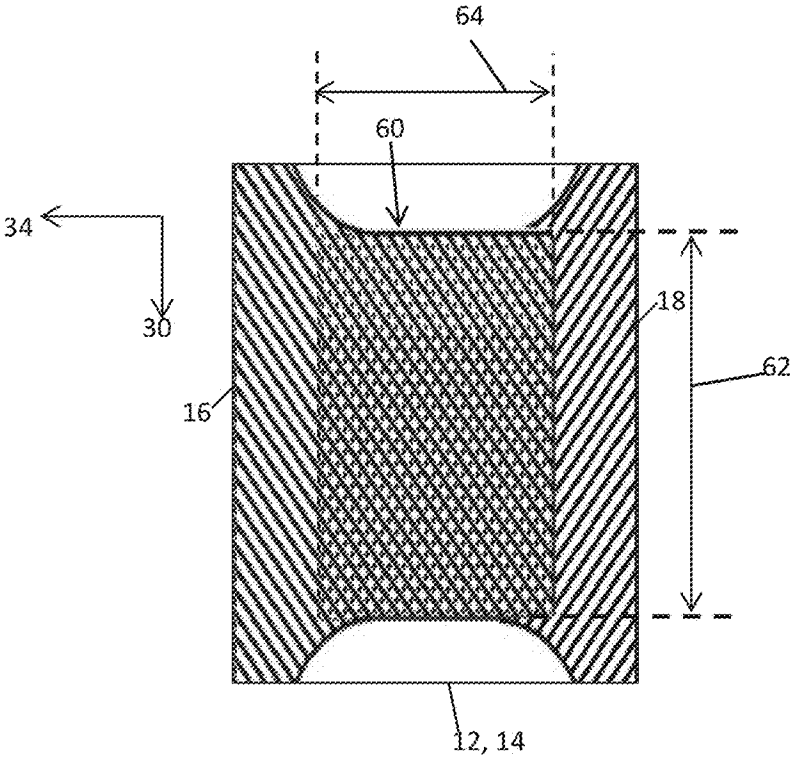
FIG. 3B illustrates an overlapping area between a pair of dielectric layers in accordance with the embodiment illustrated in FIGS. 2A-2D.
Figure 3A:
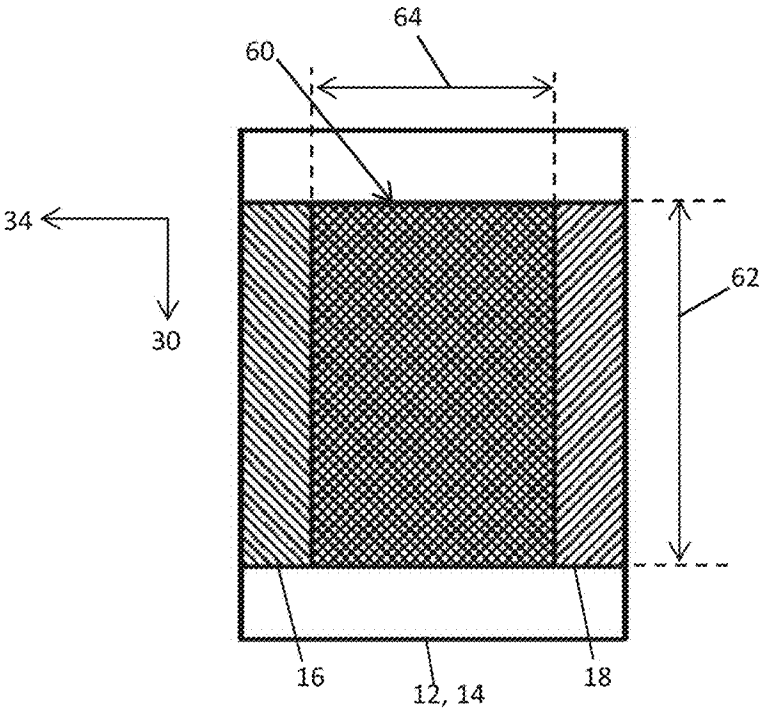
FIG. 3A illustrates an overlapping area between a pair of dielectric layers in accordance with the embodiment illustrated in FIGS. 1A-1D.

The electrodes 16, 18 may overlap or interleave as illustrated in FIGS. 1A and 2A. To better illustrate this, FIGS. 3A and 3B depicts the first dielectric layer 12 stacked on the second dielectric layer 14. FIG. 3A depicts the rectangular electrode configuration illustrated in FIGS. 1A-1D. In FIGS. 3A and 3B, the first layer 12 is shown as partially transparent such that an overlapping area 60 is shown as the combination of the cross-hatching pattern of the first electrode 16 and the cross-hatching pattern of the second electrode 18. The overlapping area may have a width 62 in the widthwise direction 30 and length 64 in the lengthwise direction 34.

Generally, a varistor having a low resistance provides a low clamping voltage. Many factors may contribute to the active resistance of varistors, such as the geometric configuration and material properties of the various components of the varistor 10. For example, the electrodes 16, 18 may provide resistance along the length of the electrodes 16, 18. Similarly the connection between the electrodes 16, 18 and the terminals 17, 19 may provide resistance. In some embodiments, at least one electrode 12 may have an electrode aspect ratio defined as the length 36 divided by the width 38. As discussed above, in some embodiments, the electrode aspect ratio may be less than about 1.

The shape of the overlapping area 60 between the electrodes 16, 18 may also affect the active resistance, and thus the clamping voltage of the varistor 10. In some embodiments, the overlapping area 60 may have an overlap aspect ratio defined as the overlap length 64 divided by the overlap width 62. As discussed above, in some embodiments, the overlap area aspect ratio may be less than about 1.

The overall shape of the varistor 10 may also affect the active resistance and, thus, the clamping voltage of the varistor 10. The varistor 10 may have an overall aspect ratio defined as the overall length 40 of the varistor 10 divided by the overall width 42 of the varistor 10. As discussed above, in some embodiments, the overall aspect ratio may be less than about 1.

Figure 4:
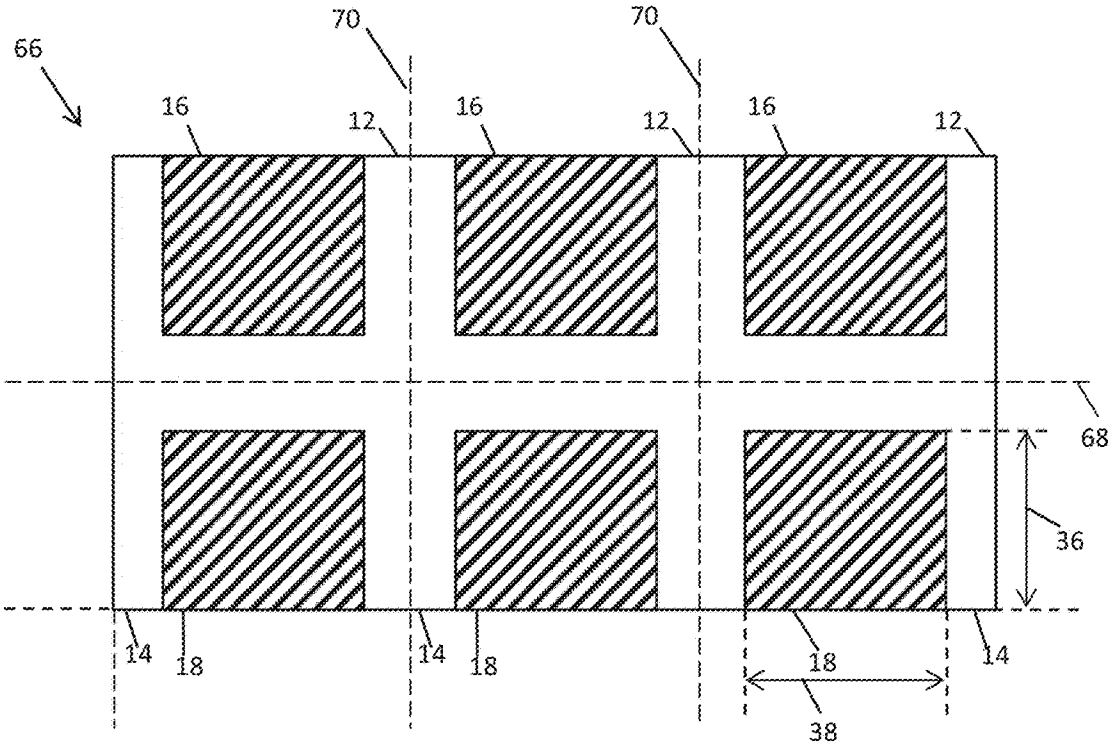
FIG. 4 illustrates a panel layout for the manufacture of a plurality of dielectric-electrode layers in accordance with the embodiment illustrated in FIGS. 1A-1D.

FIG. 4 depicts a panel layout 66 for the manufacture of a plurality of dielectric-electrode layers 12, 14 in accordance with the embodiment of the varistor 10 illustrated in FIGS. 1 and 2. The electrodes 16, 18 may be printed on a sheet of dielectric material using any suitable printing technique. For example, silk screen printing with electrode ink may be used. The individual dielectric-electrode layers 12, 14 may be stacked, diced, pressed, and/or sintered so as to form the varistor 10. For example, a guillotine may be configured to dice the laminated sheet such as along one or more longitudinal cutting line 68 and one or more lateral cutting lines 70.

Figure 5:
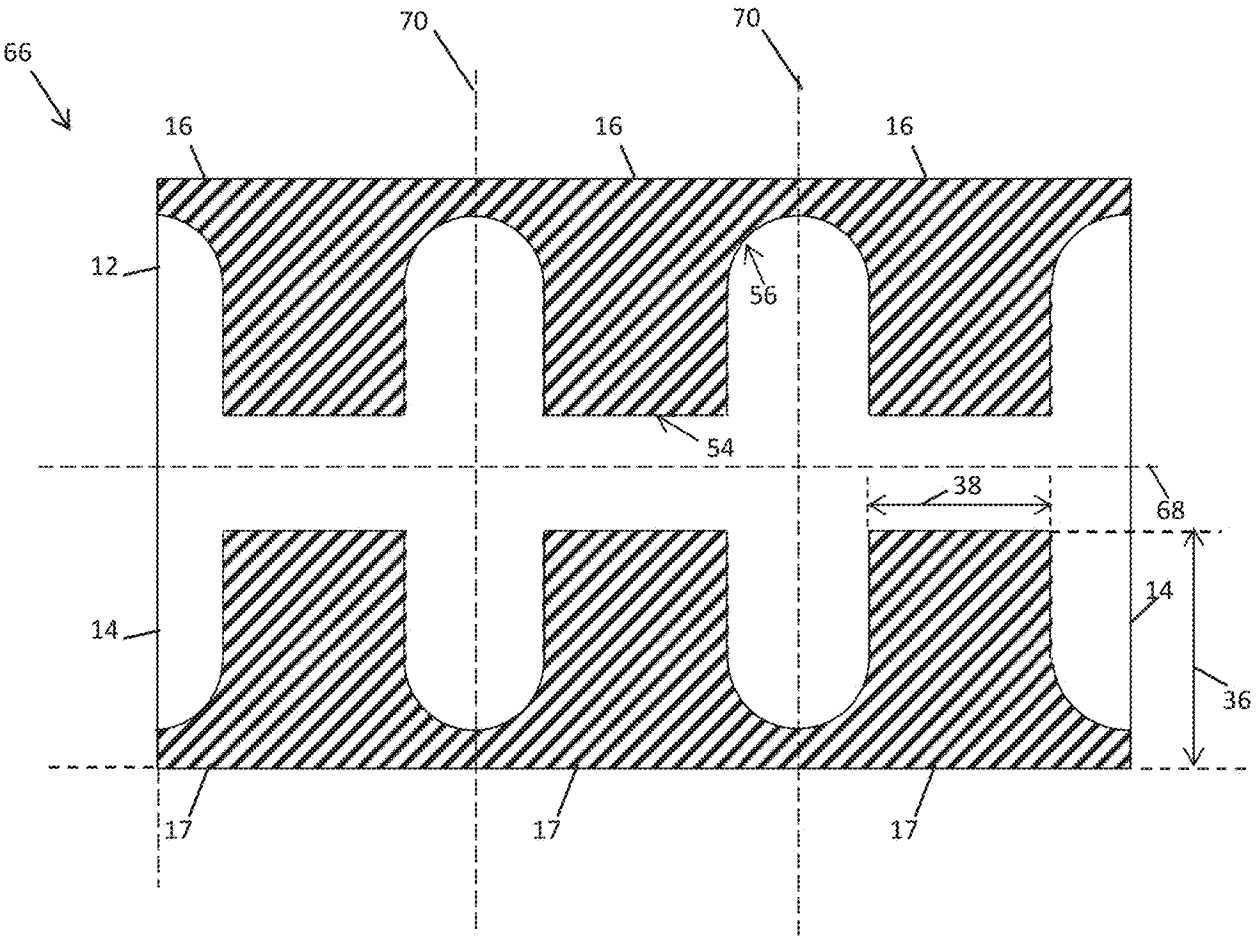
FIG. 5 illustrates a panel layout for the manufacture of a plurality of dielectric-electrode layers in accordance with the embodiment illustrated in FIGS. 2A-2D.

FIG. 5 depicts a panel layout 66 for the manufacture of a plurality of dielectric-electrode layers 12, 14 in accordance with the embodiment of the varistor 10 illustrated in FIGS. 2A-2D. The printing and cutting techniques described above may be used. As indicated above, the laminated sheet may be cut along one or more longitudinal lines 68 and one or more lateral lines 68.

Although FIGS. 4 and 5 illustrate panel layouts 66 having six electrodes 16, 17 in a three-by-two electrode arrangement, in other embodiments, the panel layout 66 may include other numbers and arrangements of electrodes. For example in some embodiments, the panel layout 66 may include 2 to 1,000 electrodes, in some embodiments 10 to 100 electrodes, in some embodiments 20 to 50 electrodes. Any suitable number of electrodes may be printed on the panel layouts 66, however.

Figure 6:
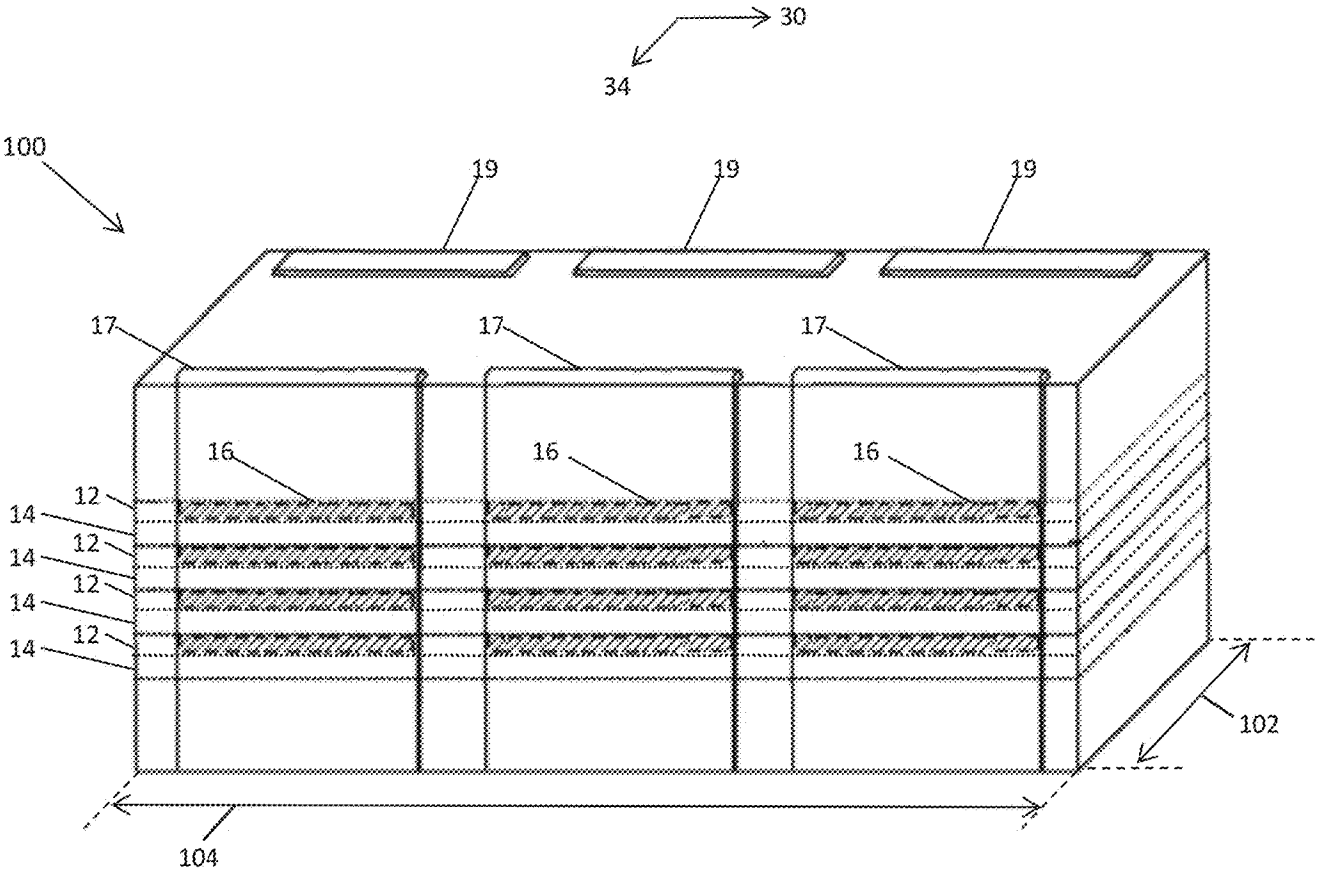
FIG. 6 illustrates a varistor array in accordance with aspects of this disclosure.

Referring to FIG. 6, in some embodiments, a varistor array 100 may be formed including a plurality of varistors. In one embodiment, the varistor array 100 may include three varistors. The varistor array 100 may include four pairs of alternating layers 12, 14, and each of the layers 12, 14 may provide three electrode 16, 18 for each varistor. The varistor array 10 illustrated in FIG. 6 may include rectangular electrodes 16, 18, as illustrated in FIGS. 1A-1D and/or T-electrodes as illustrated in FIGS. 2A-2D. The varistor array 100 may be manufactured in a similar manner as explained for the single varistor embodiments illustrated in FIGS. 1-4. For example, an electrode ink may be printed (e.g., using a silk screen) on a laminated sheet. In some embodiments, the panel layouts 66 illustrated in FIG. 4 and/or FIG. 5 may be used. As explained above, the individual dielectric-electrode layers 12, 14 may be stacked, diced, pressed, and/or sintered so as to form the varistor array 100.

The varistor array 100 may have an overall length 102 in the lengthwise 34 and an overall width 104 in the widthwise direction 30. The varistor array 100 may have an overall aspect ratio defined the overall width 104 divided by the overall length 102. As discussed above, in some embodiments, the overall aspect ratio may be less than about 1.

As a voltage transient or voltage surge occurs, current may flow between two or more of electrodes 16, 18. This may prevent current from flowing to one or more other components of a circuit board, protecting other components on the circuit board from damage. The varistor 10 and/or varistor array 100 described herein may be particularly suited for automotive applications. Other applications may include providing surge protection for both differential mode and common mode transient voltage surge protection.

The present invention may be better understood with reference to the following example.

Example

As is known in the art, the case size of electronic devices may be expressed as a four digit code (e.g., XXYY), in which the first two digits (XX) are the length of the device in millimeters (or in thousandths of an inch) and the last two digits (YY) are the width of the device in millimeters (or in thousandths of an inch). For instance, common metric case sizes may include 2012, 1608, 0603. In accordance with aspects of the present disclosure, a "reverse geometry" varistor may be provided. For example, a reverse geometry 1220 metric case size varistor may be provided (having a length of 12 millimeters and a width of 20 millimeters). The reverse geometry 1220 metric case size varistor may be "reversed" compared with a conventional 2012 metric case size varistor (having a length of 20 millimeters and a width of 12 millimeters). The reverse geometry 1220 metric case size varistor may have generally rectangular electrodes, for example. Such a reverse geometry varistor may have an electrode aspect ratio of about 0.78. In some embodiments, the reverse geometry 1220 metric case size varistor may include T-electrodes. Such a reverse geometry varistor may have an electrode aspect ratio of about 0.49. Each of the above-described reverse geometry 1220 varistors may have a respective overlap aspect ratio of about 0.48 and a respective overall aspect ratio of about 0.67.

Other examples of reverse geometry varistors in accordance with aspects of the present disclosure may include a reverse geometer 0816 varistor and a reverse geometer 0603. Each of these varistors may be configured with rectangular and/or T-electrodes.

Test Methods

The following sections provide example methods for testing varistors to determine various varistor characteristics.

Figure 7:
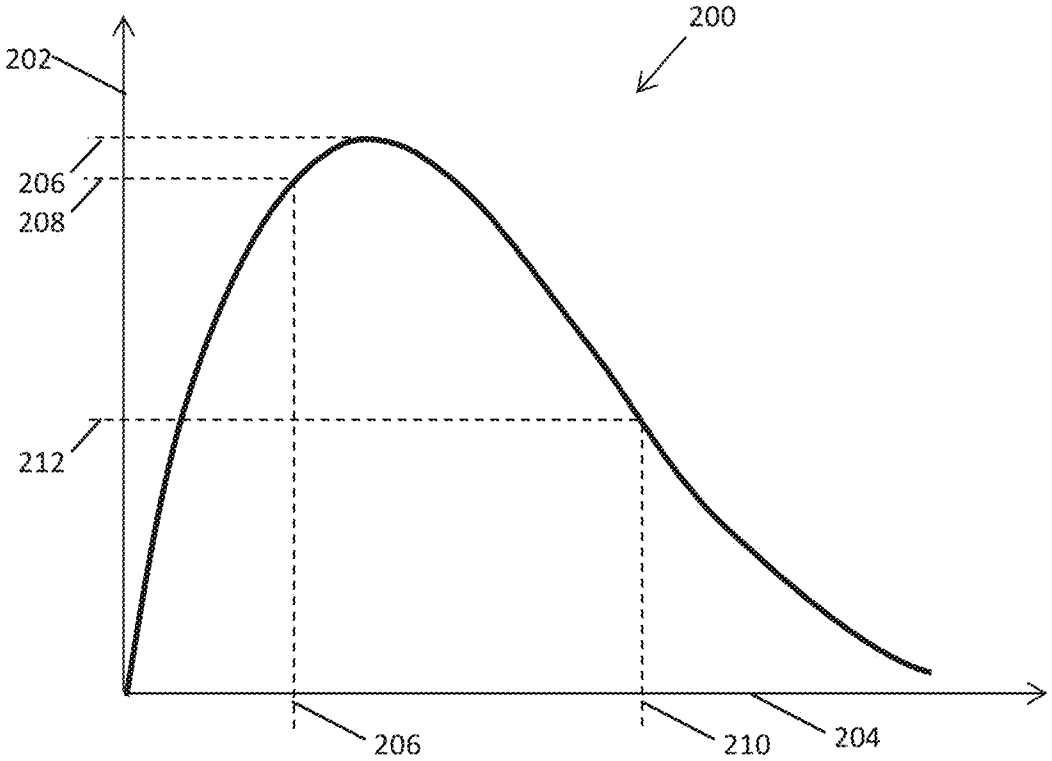
FIG. 7 illustrates an exemplary current wave used to test the clamping voltage of a varistor in accordance with aspects of the present disclosure.

The clamping voltage of the varistor may be measured using a Keithley 2400 series Source Measure Unit (SMU), for example, a Keithley 2410-C SMU. The varistor may be subjected to an 8/20 μs current wave, for example according to ANSI Standard C62.1. The current wave may have a peak current value of 1 mA. The peak current value may be selected such that it causes the varistor to "clamp" the voltage, as explained in greater detail below. An exemplary current wave is illustrated in FIG. 7. The current (vertical axis 202) is plotted against time (horizontal axis 204). The current may increase to the peak current value 206 and then decay. The "rise" time period (illustrated by vertical dotted line 206) may be from the initiation of the current pulse (at t=0) to when the current reaches 90% (illustrated by horizontal dotted line 208) of the peak current value 206. The "rise" time may be 8 μs. The "decay time" (illustrated by vertical dotted line 210) may be from the initiation of the current pulse (at t=0) to 50% (illustrated by horizontal dotted line 212) of the peak current value 206. The "decay time" may be 20 μs. The clamping voltage measured as the maximum voltage across the varistor during the current wave.

Figure 8:
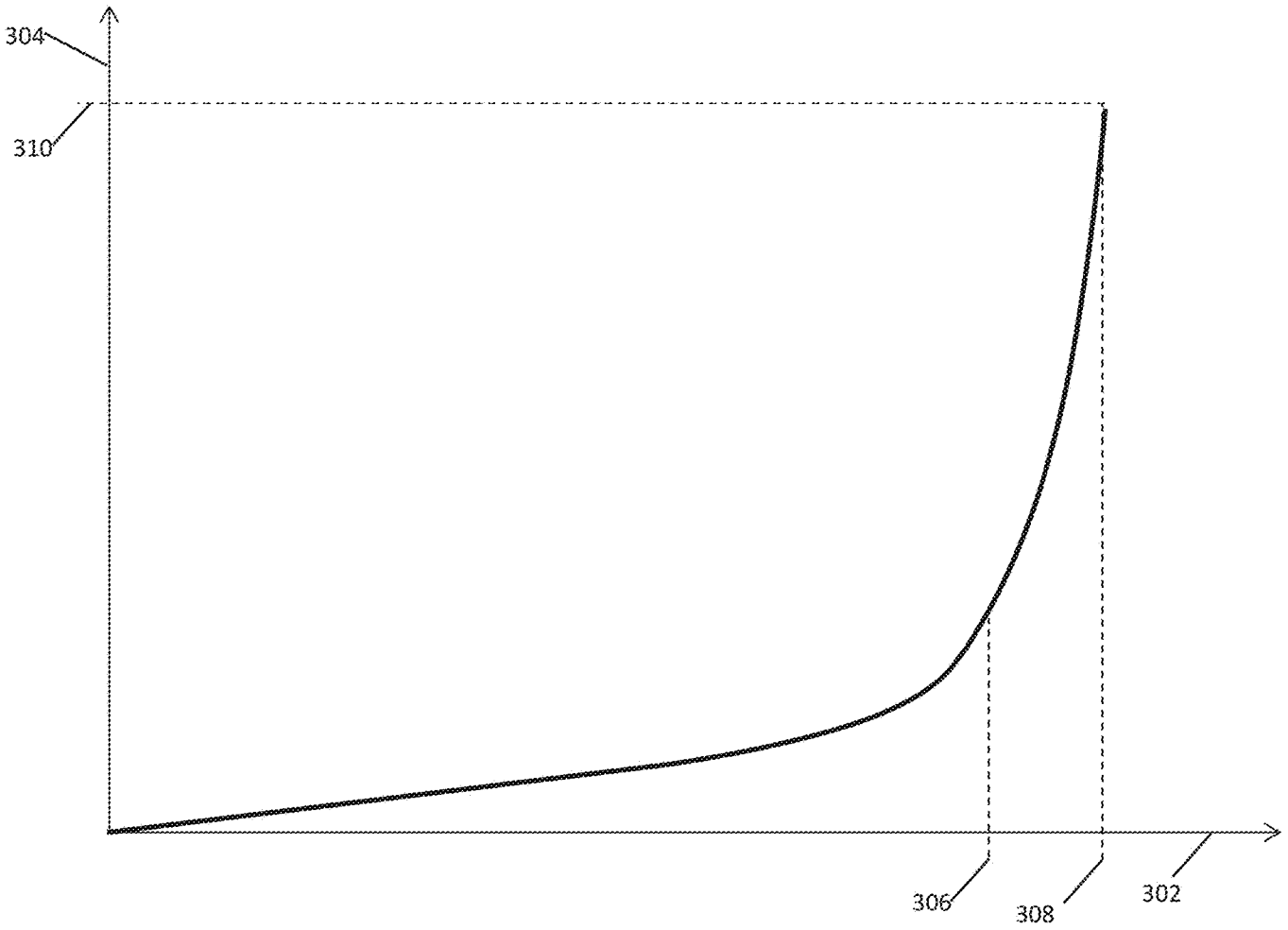
FIG. 8 illustrates current and voltage during an exemplary test of the clamping voltage of a varistor in accordance with aspects of the present disclosure.

Referring to FIG. 8, the voltage across the varistor (horizontal axis 302) is plotted against the current through the varistor (vertical axis 304). As shown in FIG. 8, once the voltage exceeds the breakdown voltage 306, additional current flow through the varistor does not significantly increase the voltage across the varistor. In other words, the varistor "clamps" the voltage at approximately the clamping voltage 308. Thus, the clamping voltage 308 may be accurately measured as the maximum voltage measured across the varistor during the current wave. This remains true as long as the peak current value 310 is not so great that it damages the varistor.

These and other modifications and variations of the present invention may be practiced by those of ordinary skill in the art, without departing from the spirit and scope of the present invention. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed is:

1. A varistor having a rectangular configuration defining first and second opposing side surfaces offset in a widthwise direction and first and second opposing end surfaces offset in a lengthwise direction, the varistor comprising:

a first terminal adjacent the first opposing end surface;

a first electrode layer including a first electrode having an electrode length in the lengthwise direction and an electrode width in the widthwise direction, the first electrode connected with the first terminal along the electrode width of the first electrode;

a second terminal adjacent the second opposing end surface; and a second electrode layer including a second electrode having an electrode length in the lengthwise direction and an electrode width in the widthwise direction, the second electrode connected with the second terminal along the electrode width of the second electrode;

wherein:

at least one of the first or second electrodes has an electrode aspect ratio less than about 1.

2. The varistor of claim 1, wherein a clamping voltage of the varistor is less than about 12 volts.

3. The varistor of claim 1, wherein:

the first electrode overlaps the second electrode in both the widthwise and lengthwise directions to define an overlapping area having an overlap width in the widthwise direction and an overlap length in the lengthwise direction; and the overlapping area has an overlap aspect ratio less than about 1.

4. The varistor of claim 1, further comprising:

an overall length in the lengthwise direction between the first and second opposing end surfaces and an overall width in the widthwise direction between first and second opposing side surfaces; and an overall aspect ratio less than about 1.

5. The varistor of claim 1; wherein at east one of the first electrode or second electrode is a T-electrode.

6. The varistor of claim 1, wherein the first terminal is connected with the first electrode along at least one of the first opposing side surface or second opposing side surface of the varistor.

7. The varistor of claim 1, wherein at least one of the first electrode or second electrode intersects at least one of the first opposing side surface or second opposing side surface.

8. A varistor having a rectangular configuration defining first and second opposing side surfaces offset in a widthwise direction and first and second opposing end surfaces offset in a lengthwise direction, the varistor comprising:

a first terminal adjacent the first opposing end surface;

a first electrode layer including a first electrode, the first electrode connected with the first terminal; and a second terminal adjacent the second opposing end surface; and a second electrode layer including a second electrode; the second electrode connected with the second terminal;

wherein:

the second electrode overlaps the first electrode along an overlapping area having an overlap width in the widthwise direction and an overlap length in the lengthwise direction; and the overlapping area has an overlap aspect ratio less than about 1.

9. The varistor of claim 8, further comprising:

an overall length in the lengthwise direction between the first and second opposing end surfaces and an overall width in the widthwise direction between first and second opposing side surfaces; and an overall aspect ratio less than about 1.

10. The varistor of claim 8, wherein a clamping voltage of the varistor is less than about 12 volts.

11. The varistor of claim 8, wherein at least one of the first electrode or second electrode is a T-electrode.

12. The varistor of claim 8, wherein the first terminal is connected with the first electrode along at least one of the first opposing side surface or second opposing side surface of the varistor.

13. The varistor of claim 8, wherein at least one of the first electrode or second electrode intersects at least one of the first opposing side surface or second opposing side surface.

14. A varistor array having a rectangular configuration defining first and second opposing side surfaces offset in a widthwise direction and first and second opposing end surfaces offset in a lengthwise direction, the varistor array comprising:

a first terminal associated with the first opposing end surface;

a first electrode layer including a first set of electrodes, each of the first set of electrodes being connected with the first terminal and having an electrode length in the lengthwise direction and an electrode width in the widthwise direction;

a second terminal associated with the second opposing end surface; and a second electrode layer including a second set of electrodes, each of the second set of electrodes being connected with the second terminal and having an electrode length in the lengthwise direction and an electrode width in the widthwise direction;

wherein:

at least one electrode of the first set of electrodes or second set of electrodes has an electrode aspect ratio less than about 1.

15. The varistor array of claim 14, wherein:

at least one of the electrodes of the first set of electrodes overlaps at least one of the electrodes of the second set of electrodes in the lengthwise and widthwise directions to define an overlapping area having an overlap width in the widthwise direction and an overlap length in the lengthwise direction; and the overlapping area has an overlap aspect ratio less than about 1.

16. The varistor array of claim 14, further comprising:

an overall length in the lengthwise direction between the first and second opposing end surfaces and an overall width in the widthwise direction between the first and second opposing side surfaces; and an overall aspect ratio less than 1.

17. The varistor array of claim 14, wherein at least one of the first set of electrodes or second set of electrodes is a T-electrode.

18. The varistor array of claim 14, wherein the first terminal is connected with the first electrode along at least one of the first opposing side surface or second opposing side surface of the varistor.

19. The varistor array of claim 14, wherein at least one of the first set of electrodes or second set of electrodes intersects at least one of the first opposing side surface or second opposing side surface.

20. The varistor array of claim 14, wherein the clamping voltage between the first terminal and second terminal of the varistor array is less than about 12 volts.

* * * * *